US009024854B2

(12) United States Patent
Nakata et al.

(10) Patent No.: US 9,024,854 B2
(45) Date of Patent: May 5, 2015

(54) LIQUID CRYSTAL DISPLAY DEVICE AND DRIVING METHOD OF A LIQUID CRYSTAL DISPLAY DEVICE

(75) Inventors: Jun Nakata, Osaka (JP); Masaki Uehata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 290 days.

(21) Appl. No.: 13/695,328

(22) PCT Filed: Mar. 2, 2011

(86) PCT No.: PCT/JP2011/054809

§ 371 (c)(1),
(2), (4) Date: Oct. 30, 2012

(87) PCT Pub. No.: WO2011/145379

PCT Pub. Date: Nov. 24, 2011

(65) Prior Publication Data

US 2013/0044098 A1 Feb. 21, 2013

(30) Foreign Application Priority Data

May 21, 2010 (JP) ..... 2010-117805

(51) Int. Cl.
*G09G 3/36* (2006.01)

(52) U.S. Cl.
CPC ..... *G09G 3/3655* (2013.01); *G09G 2320/0285* (2013.01); *G09G 2330/021* (2013.01); *G09G 2360/16* (2013.01)

(58) Field of Classification Search
CPC ..... G06F 3/038; G09G 5/00
USPC ..... 345/98, 204, 690, 88, 89, 211
See application file for complete search history.

(56) References Cited

U.S. PATENT DOCUMENTS

2002/0180673 A1 12/2002 Tsuda et al.
2005/0007331 A1* 1/2005 Yamazaki et al. ..... 345/92
2006/0007092 A1 1/2006 Sekiguchi et al.
2006/0152462 A1* 7/2006 Furihata et al. ..... 345/98

(Continued)

FOREIGN PATENT DOCUMENTS

JP 10-097227 A 4/1998
JP 2002-014321 A 1/2002
JP 2006-003512 A 1/2006

(Continued)

OTHER PUBLICATIONS

An International Search Report, dated Jun. 7, 2011, issued in International Application No. PCT/JP2011/054809.

*Primary Examiner* — Pegeman Karimi
(74) *Attorney, Agent, or Firm* — Lowe Hauptman & Ham, LLP

(57) ABSTRACT

A liquid crystal display device includes a gate driver, a source driver and a common driver. An input video signal is stored in a line memory and a gray scale with which an applied voltage becomes highest is detected from data corresponding to 1 line among the signal. A common electrode is driven by a common voltage being reduced in accordance with the gray scale and having a low effective value. The driver is driven by an output controlled in accordance with the voltage thus reduced. A voltage applied to a common electrode is set by using a LUT and a common voltage is set by using a LUT. It is therefore possible to provide a liquid crystal display device and a method of driving the liquid crystal display device, each of which can reduce power consumption.

4 Claims, 13 Drawing Sheets

(56) References Cited

U.S. PATENT DOCUMENTS

| | | | | |
|---|---|---|---|---|
| 2008/0024417 | A1* | 1/2008 | Huang et al. | 345/98 |
| 2009/0066627 | A1* | 3/2009 | Yin | 345/94 |

FOREIGN PATENT DOCUMENTS

| | | | |
|---|---|---|---|
| JP | 2006-163025 | A | 6/2006 |
| JP | 2006-195152 | A | 7/2006 |
| JP | 2008-064971 | A | 3/2008 |

* cited by examiner

FIG. 3

(a)

301

| OUTPUT GRAY SCALE | COM VOLTAGE |
|---|---|
| 0 | 0.5 |
| 1 | 0.7 |
| 2 | 0.8 |
| 3 | 0.9 |
| ··· | ··· |
| n | 3.6 |
| ··· | ··· |
| 253 | 4.7 |
| 254 | 4.9 |
| 255 | 5.0 |

DETECTED MAXIMUM GRAY SCALE

LUT1

(b)

302

| OUTPUT GRAY SCALE | | DETECTED MAXIMUM GRAY SCALE | | | | | | | | | |
|---|---|---|---|---|---|---|---|---|---|---|---|
| | | 0 | 1 | 2 | 3 | ··· | n | ··· | 253 | 254 | 255 |
| INPUT GRAY SCALE | 0 | 0 | 0 | 0 | 0 | ··· | 0 | ··· | 0 | 0 | 0 |
| | 1 | – | 255 | 128 | 64 | ··· | 4 | ··· | 1 | 1 | 1 |
| | 2 | – | – | 255 | 192 | ··· | 8 | ··· | 3 | 2 | 2 |
| | 3 | – | – | – | 255 | ··· | 10 | ··· | 4 | 4 | 3 |
| | ··· | ··· | ··· | ··· | ··· | ··· | ··· | ··· | ··· | ··· | ··· |
| | n | – | – | – | – | ··· | 255 | ··· | 130 | 129 | n |
| | ··· | ··· | ··· | ··· | ··· | ··· | ··· | ··· | ··· | ··· | ··· |
| | 253 | – | – | – | – | ··· | – | ··· | 255 | 254 | 253 |
| | 254 | – | – | – | – | ··· | – | ··· | – | 255 | 254 |
| | 255 | – | – | – | – | ··· | – | ··· | – | – | 255 |

LUT2

FIG. 4

(a)

| COLUMN NUMBER | 1 | 2 | 3 | ··· | n | ··· | N |
|---|---|---|---|---|---|---|---|
| GRAY SCALE | 12 | 18 | 25 | ··· | 255 | ··· | 83 |

401

(b)

| | | COM VOLTAGE |
|---|---|---|
| DETECTED MAXIMUM GRAY SCALE | 0 | 0.5 |
| | 1 | 0.7 |
| | 2 | 0.8 |
| | 3 | 0.9 |
| | ··· | ··· |
| | n | 3.6 |
| | ··· | ··· |
| | 253 | 4.7 |
| | 254 | 4.9 |
| | 255 | 5.0 |

402

LUT1

(c)

403

| OUTPUT GRAY SCALE | | DETECTED MAXIMUM GRAY SCALE | | | | | | | | | |
|---|---|---|---|---|---|---|---|---|---|---|---|
| | | 0 | 1 | 2 | 3 | ··· | n | ··· | 253 | 254 | 255 |
| INPUT GRAY SCALE | 0 | 0 | 0 | 0 | 0 | ··· | 0 | ··· | 0 | 0 | 0 |
| | 1 | – | 255 | 128 | 64 | ··· | 4 | ··· | 1 | 1 | 1 |
| | 2 | – | – | 255 | 192 | ··· | 8 | ··· | 3 | 2 | 2 |
| | 3 | – | – | – | 255 | ··· | 10 | ··· | 4 | 4 | 3 |
| | ··· | ··· | ··· | ··· | ··· | ··· | ··· | ··· | ··· | ··· | ··· |
| | n | – | – | – | – | ··· | 255 | ··· | 130 | 129 | n |
| | ··· | ··· | ··· | ··· | ··· | ··· | ··· | ··· | ··· | ··· | ··· |
| | 253 | – | – | – | – | ··· | – | ··· | 255 | 254 | 253 |
| | 254 | – | – | – | – | ··· | – | ··· | – | 255 | 254 |
| | 255 | – | – | – | – | ··· | – | ··· | – | – | 255 |

LUT2

FIG. 6

(a)

| COLUMN NUMBER | 1 | 2 | 3 | ··· | m | ··· | M |
|---|---|---|---|---|---|---|---|
| GRAY SCALE | 12 | 18 | 25 | ··· | n | ··· | 83 |

601

(b)

| DETECTED MAXIMUM GRAY SCALE | COM VOLTAGE |
|---|---|
| 0 | 0.5 |
| 1 | 0.7 |
| 2 | 0.8 |
| 3 | 0.9 |
| ··· | ··· |
| n | 3.6 |
| ··· | ··· |
| 253 | 4.7 |
| 254 | 4.9 |
| 255 | 5.0 |

602

LUT1

(c)

| OUTPUT GRAY SCALE | | DETECTED MAXIMUM GRAY SCALE | | | | | | | | | |
|---|---|---|---|---|---|---|---|---|---|---|---|
| | | 0 | 1 | 2 | 3 | ··· | n | ··· | 253 | 254 | 255 |
| INPUT GRAY SCALE | 0 | 0 | 0 | 0 | 0 | ··· | 0 | ··· | 0 | 0 | 0 |
| | 1 | – | 255 | 128 | 64 | ··· | 4 | ··· | 1 | 1 | 1 |
| | 2 | – | – | 255 | 192 | ··· | 8 | ··· | 3 | 2 | 2 |
| | 3 | – | – | – | 255 | ··· | 10 | ··· | 4 | 4 | 3 |
| | ··· | ··· | ··· | ··· | ··· | ··· | ··· | ··· | ··· | ··· | ··· |
| | n | – | – | – | – | ··· | 255 | ··· | 130 | 129 | n |
| | ··· | ··· | ··· | ··· | ··· | ··· | ··· | ··· | ··· | ··· | ··· |
| | 253 | – | – | – | – | ··· | – | ··· | 255 | 254 | 253 |
| | 254 | – | – | – | – | ··· | – | ··· | – | 255 | 254 |
| | 255 | – | – | – | – | ··· | – | ··· | – | – | 255 |

603

LUT2

| GRAY SCALE | SOURCE AMPLITUDE VOLTAGE |
|---|---|
| 0 | 0.50 |
| 1 | 0.70 |
| 2 | 0.80 |
| 3 | 0.90 |
| ... | ... |
| n | 3.60 |
| ... | ... |
| 253 | 4.00 |
| 254 | 4.95 |
| 255 | 5.00 |

| OUTPUT GRAY SCALE | | COM AMPLITUDE VOLTAGE |
|---|---|---|
| DETECTED MAXIMUM GRAY SCALE | 0 | 0.0 |
| | 1 | 0.0 |
| | 2 | 0.0 |
| | 3 | 0.0 |
| | ... | ... |
| | n | 3.6 |
| | ... | ... |
| | 253 | 4.7 |
| | 254 | 4.9 |
| | 255 | 5.0 |

FIG. 9 (a)

| | COM AMPLITUDE (V) | | | | | |
|---|---|---|---|---|---|---|
| GRAY SCALE | 5 | 4 | 3 | 2 | 1 | 0 |
| 0 | 0.5 | 0 | −0.5 | −1 | −1.5 | −2 |
| 4 | 0.9 | 0.4 | −0.1 | −0.6 | −1.1 | −1.6 |
| 16 | 1.2 | 0.7 | 0.2 | −0.3 | −0.8 | −1.3 |
| 24 | 1.3 | 0.8 | 0.3 | −0.2 | −0.7 | −1.2 |
| 32 | 1.4 | 0.9 | 0.4 | −0.1 | −0.6 | −1.1 |
| 40 | 1.5 | 1 | 0.5 | 0 | −0.5 | −1 |
| 48 | 1.6 | 1.1 | 0.6 | 0.1 | −0.4 | −0.9 |
| 56 | 1.7 | 1.2 | 0.7 | 0.2 | −0.3 | −0.8 |
| 64 | 1.75 | 1.25 | 0.75 | 0.25 | −0.25 | −0.75 |
| 72 | 1.8 | 1.3 | 0.8 | 0.3 | −0.2 | −0.7 |
| 80 | 1.85 | 1.35 | 0.85 | 0.35 | −0.15 | −0.65 |
| 88 | 1.9 | 1.4 | 0.9 | 0.4 | −0.1 | −0.6 |
| 96 | 1.95 | 1.45 | 0.95 | 0.45 | −0.05 | −0.55 |
| 104 | 2 | 1.5 | 1 | 0.5 | 0 | −0.5 |
| 112 | 2.05 | 1.55 | 1.05 | 0.55 | 0.05 | −0.45 |
| 120 | 2.1 | 1.6 | 1.1 | 0.6 | 0.1 | −0.4 |
| 128 | 2.15 | 1.65 | 1.15 | 0.65 | 0.15 | −0.35 |
| 136 | 2.2 | 1.7 | 1.2 | 0.7 | 0.2 | −0.3 |
| 144 | 2.28 | 1.78 | 1.28 | 0.78 | 0.28 | −0.22 |
| 152 | 2.35 | 1.85 | 1.35 | 0.85 | 0.35 | −0.15 |
| 160 | 2.4 | 1.9 | 1.4 | 0.9 | 0.4 | −0.1 |
| 168 | 2.5 | 2 | 1.5 | 1 | 0.5 | 0 |
| 176 | 2.6 | 2.1 | 1.6 | 1.1 | 0.6 | 0.1 |
| 184 | 2.7 | 2.2 | 1.7 | 1.2 | 0.7 | 0.2 |
| 192 | 2.8 | 2.3 | 1.8 | 1.3 | 0.8 | 0.3 |
| 200 | 2.9 | 2.4 | 1.9 | 1.4 | 0.9 | 0.4 |
| 208 | 3 | 2.5 | 2 | 1.5 | 1 | 0.5 |
| 216 | 3.1 | 2.6 | 2.1 | 1.6 | 1.1 | 0.6 |
| 224 | 3.3 | 2.8 | 2.3 | 1.8 | 1.3 | 0.8 |
| 232 | 3.5 | 3 | 2.5 | 2 | 1.5 | 1 |
| 240 | 3.7 | 3.2 | 2.7 | 2.2 | 1.7 | 1.2 |
| 248 | 4.1 | 3.6 | 3.1 | 2.6 | 2.1 | 1.6 |
| 255 | 4.9 | 4.4 | 3.9 | 3.4 | 2.9 | 2.4 |

901 903 902 UNUSED REGION

FIG. 9 (b)

| GRAY SCALE | SOURCE AMPLITUDE |
|---|---|
| 0 | −4 |
| 4 | −3.2 |
| 16 | −2.6 |
| 24 | −2.4 |
| 32 | −2.2 |
| 40 | −2 |
| 48 | −1.8 |
| 56 | −1.6 |
| 64 | −1.5 |
| 72 | −1.4 |
| 80 | −1.3 |
| 88 | −1.2 |
| 96 | −1.1 |
| 104 | −1 |
| 112 | −0.9 |
| 120 | −0.8 |
| 128 | −0.7 |
| 136 | −0.6 |
| 144 | −0.44 |
| 152 | −0.3 |
| 160 | −0.2 |
| 168 | 0 |
| 176 | 0.2 |
| 184 | 0.4 |
| 192 | 0.6 |
| 200 | 0.8 |
| 208 | 1 |
| 216 | 1.2 |
| 224 | 1.6 |
| 232 | 2 |
| 240 | 2.4 |
| 248 | 3.2 |
| 255 | 4.8 |

904

| OUTPUT GRAY SCALE | | DETECTED MAXIMUM GRAY SCALE | | | | | | | | | |
|---|---|---|---|---|---|---|---|---|---|---|---|
| | | 0 | 1 | 2 | 3 | ··· | n | ··· | 253 | 254 | 255 |
| INPUT GRAY SCALE | 0 | 0 | 0 | 0 | 0 | ··· | 0 | ··· | 0 | 0 | 0 |
| | 1 | – | 255 | 128 | 64 | ··· | 4 | ··· | 1 | 1 | 1 |
| | 2 | – | – | 255 | 192 | ··· | 8 | ··· | 3 | 2 | 2 |
| | 3 | – | – | – | 255 | ··· | 10 | ··· | 4 | 4 | 3 |
| | ··· | ··· | ··· | ··· | ··· | ··· | ··· | ··· | ··· | ··· | ··· |
| | n | – | – | – | – | ··· | 255 | ··· | 130 | 129 | n |
| | ··· | ··· | ··· | ··· | ··· | ··· | ··· | ··· | ··· | ··· | ··· |
| | 253 | – | – | – | – | ··· | – | ··· | 255 | 254 | 253 |
| | 254 | – | – | – | – | ··· | – | ··· | – | 255 | 254 |
| | 255 | – | – | – | – | ··· | – | ··· | – | – | 255 |

LIQUID CRYSTAL DISPLAY DEVICE AND DRIVING METHOD OF A LIQUID CRYSTAL DISPLAY DEVICE

RELATED APPLICATIONS

The present application is a National Stage of International Application No. PCT/JP2011/054809, filed Mar. 2, 2011, and claims priority from, Japanese Application No. 2010-117805, filed May 21, 2010.

TECHNICAL FIELD

The present invention relates to a liquid crystal display device and a method of driving a liquid crystal display device. More specifically, the present invention relates to a liquid crystal display device and a method of driving a liquid crystal display device, each of which is capable of having a reduction in power consumption.

BACKGROUND ART

A liquid crystal display device has high display quality.

For this reason, the liquid crystal display device has been widely used as a display device of a portable device (such as a mobile phone), a display device of a television receiver, and the like. Meanwhile, since prevention of global warming due to carbon dioxide emission has been regarded as an important environmental issue, there has been strong demand that such a liquid crystal display device has a reduction in power consumption.

Patent Literature 1 describes a technique in which, in order to have a reduction in power consumption, a liquid crystal display device is driven with a low frequency. Patent Literature 2 describes a liquid crystal display device which can be switched into a low-power consumption mode (energy-saving mode) in which brightness of a backlight, or the like is reduced. Further, Patent Literature 3 describes a liquid crystal display device and a method of driving the liquid crystal display device, each of which can have a reduction in power consumption in the following manner. That is, with a liquid crystal display panel which can carry out (i) normal driving by which an entire region of the liquid crystal display panel is driven and (ii) a partial driving by which an image is displayed in a partial region of the liquid crystal display panel and a background is displayed in the other region of the liquid crystal display panel, a signal line driving circuit and a counter electrode driving circuit are stopped being driven during a time period in which the partial driving is carried out.

CITATION LIST

Patent Literature

Patent Literature 1

Japanese Patent Application Publication, Tokukai, No. 2002-14321 A (Publication Date: Jan. 18, 2002)

Patent Literature 2

Japanese Patent Application Publication, Tokukai, No. 2008-64971 A (Publication Date: Mar. 21, 2008)

Patent Literature 3

Japanese Patent Application Publication, Tokukai, No. 2006-3512 A (Publication Date: Jan. 5, 2006)

SUMMARY OF INVENTION

Technical Problem

According to the technique described in Patent Literature 1, it is possible to have a reduction in power consumption.

However, the technique described in Patent Literature 1 has a problem that an unignorable flicker might be generated while an image is displayed. The technique described in Patent Literature 2 has a problem that there is a reduction in visibility of a displayed image when brightness of a backlight is reduced. Further, according to the technique described in Patent Literature 3, although power saving driving can be carried out during a time period in which the partial driving is carried out, no power saving effect can be achieved during a time period in which the normal driving is carried out.

The present invention is made in view of the problems. An object of the present invention is to provide a liquid crystal display device and a method of driving a liquid crystal display device, with each of which (i) no flicker is generated, (ii) there is no reduction in visibility of a displayed image due to a reduction in brightness of a backlight, and (iii) low power consumption driving can be realized without carrying out partial driving.

Solution to Problem

In order to attain the object, a method of the present invention, for driving a liquid crystal display device which carries out such common voltage reversal driving that a voltage applied to a common electrode is reversed per predetermined time period, includes the steps of: setting a certain time period in a video signal as a detection time period for detecting a maximum gray scale; reducing a common voltage applied to the common electrode in accordance with a gray scale with which an applied voltage in the detection time period becomes highest; and carrying out driving with a common voltage whose effective value is low.

With the arrangement, a liquid crystal display device is driven with the use of a common voltage whose effective value is low. It is therefore possible to carry out driving with lower power than that of a conventional driving method which carries out driving with the use of a constant common voltage.

In order to attain the object, A liquid crystal display device for carrying out such common voltage reversal driving that a common voltage is reversed per predetermined time period, includes: a gate driver; a source driver; a common driver; a memory for (i) setting a certain time period in a video signal as a detection time period for detecting a maximum gray scale, and (ii) storing a signal corresponding to the certain time period; a detector for detecting, among the signal which corresponds to the certain time period and is stored in the memory, a gray scale X with which an applied voltage becomes highest; a first look-up table with which a lowest common voltage Y in a range for displaying the gray scale X is selected with the use of (i) a signal corresponding to a previous detection time period and (ii) a gray scale X in the signal corresponding to the previous detection time period; and a second look-up table with which an optimum $\gamma$ setting for the common voltage Y is selected.

With the arrangement, it is possible to provide a liquid crystal display device which has a reduction in power consumption while maintaining high display quality.

Additional objects, features, and strengths of the present invention will be made clear by the description below. Further, the advantages of the present invention will be evident from the following explanation in reference to the drawings.

Advantageous Effects of Invention

As mentioned above, according to a liquid crystal display device of the present invention and a method of the present invention, for driving a liquid crystal display device, it is possible to provide a liquid crystal display device and a method of driving a liquid crystal display device, each of which has a reduction in power consumption while maintaining high display quality. Further, according to the present invention described above, it is possible to provide a liquid crystal display device and a method of driving a liquid crystal display device, each of which can have a reduction in power consumption not only in a time period during which partial driving is carried out but also in a time period during which normal driving is carried out.

BRIEF DESCRIPTION OF DRAWINGS (a) of FIG. 1 is a view illustrating a basic structure of a display device of the present invention.

(b) of FIG. 1 is a view showing a basic method of driving a display device of the present invention.

(c) of FIG. 1 is a view showing a basic method of driving a display device of the present invention.

(d) of FIG. 1 is a view showing an outline of an operation of a method of driving a conventional liquid crystal display device.

FIG. 3 is a view showing examples of a LUT 1 and a LUT 2, and explaining how the LUT 1 and LUT 2 are used.

FIG. 4 is an explanatory view showing how the LUT 1 and LUT 2 are used based on specific gray scale data (video signal).

FIG. 6 is an explanatory view showing how the LUT 1 and LUT 2 are used based on other gray scale data (video signal).

Figure 8:
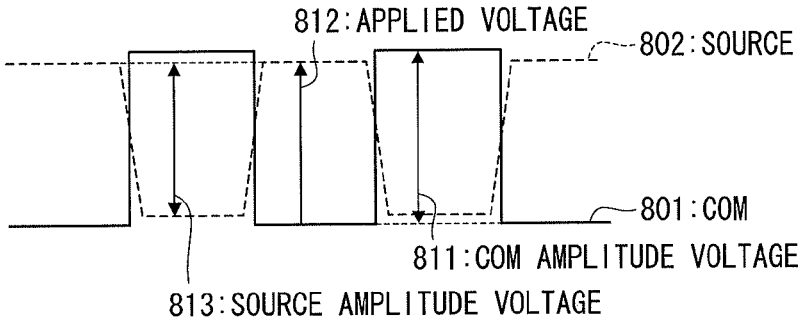
Figure 8:
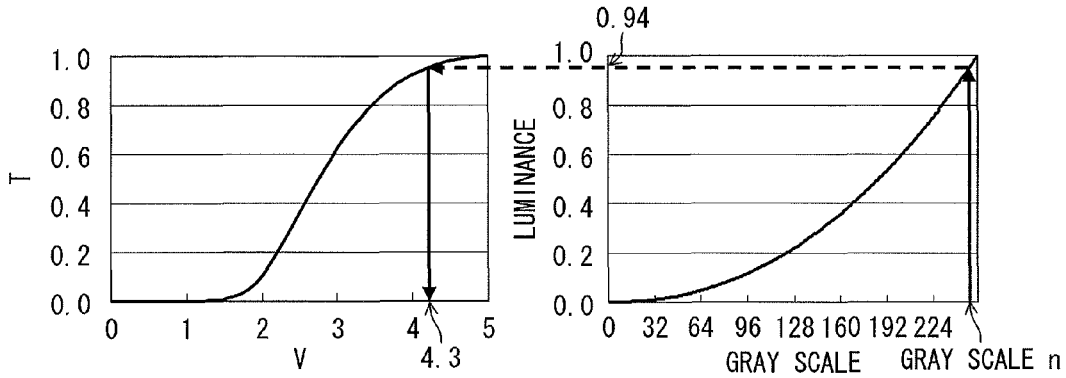

(a) of FIG. 8 is a view showing how to set the LUT 1.

(b) of FIG. 8 is a view showing how to set the LUT 1.

(c) of FIG. 8 is a view showing how to set the LUT 1.

(d) of FIG. 8 is a view showing how to set the LUT 1.

Figure 9:
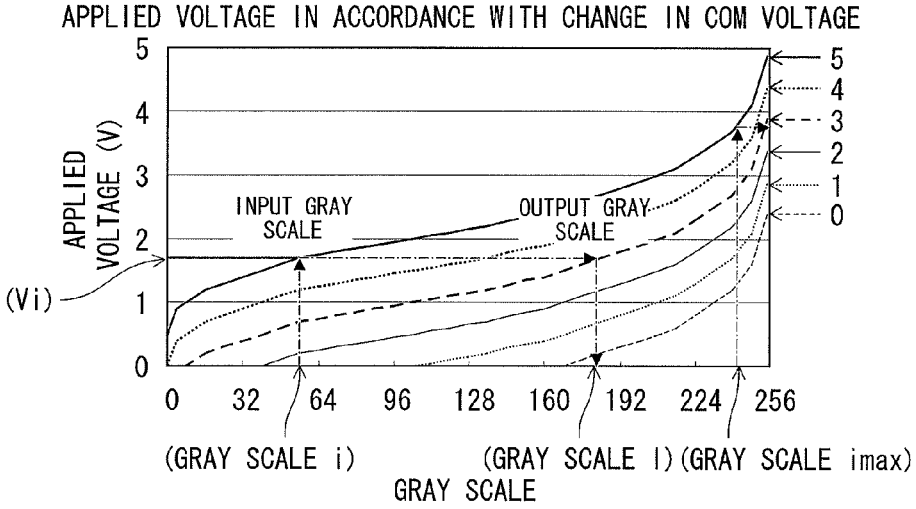

(a) of FIG. 9 is a view showing how to set the LUT 2.

(b) of FIG. 9 is a view showing how to set the LUT 2.

(c) of FIG. 9 is a view showing how to set the LUT 2.

(d) of FIG. 9 is a view showing how to set the LUT 2.

DESCRIPTION OF EMBODIMENTS

Details of an embodiment of the present invention are described below with reference to drawings. In order to put into practice the present invention, various limitations are presented as preferable examples in the following explanations. However, a technical scope of the present invention is not limited to the following example and descriptions of drawings.

EXAMPLE

An example of the present invention is described below with reference to (a) of FIG. 1 through (d) of FIG. 1.

Figure 1:
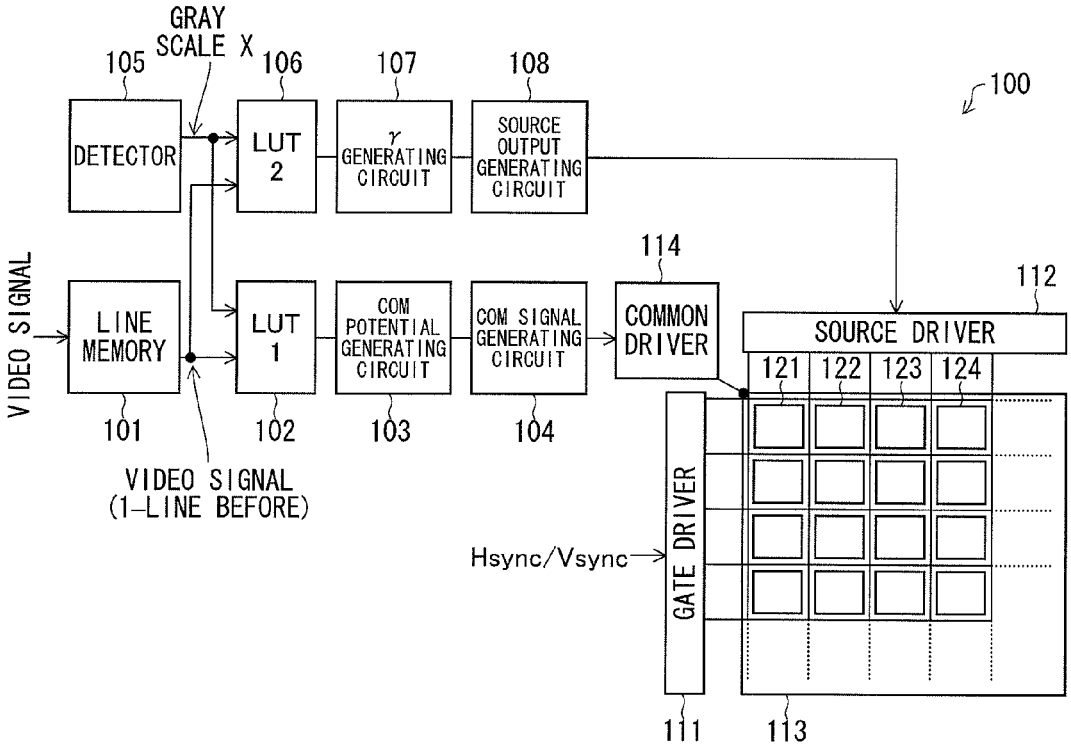
Figure 1:
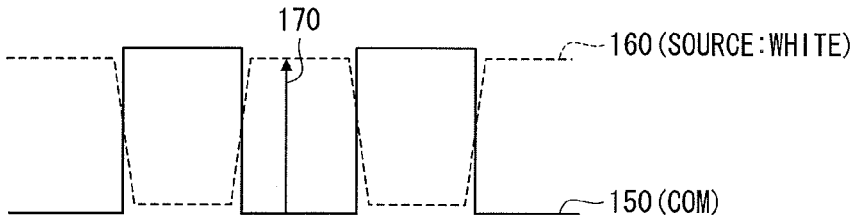
Figure 1:
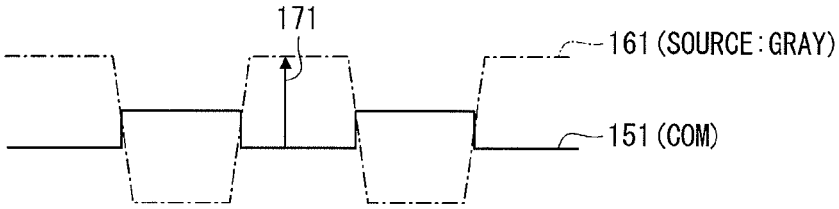
Figure 1:
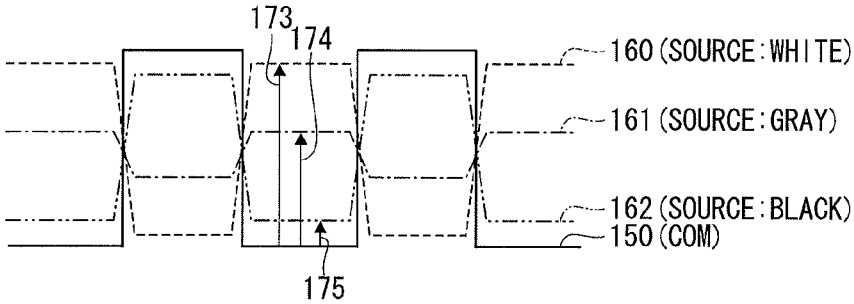

(a) of FIG. 1 is a view illustrating a structure of a liquid crystal display device in accordance with the present invention. (b) and (c) of FIG. 1 are views explaining an operational principle of how to drive a liquid crystal display device in accordance with the present invention. (d) of FIG. 1 is a view showing an outline of an operation of a method of driving a conventional liquid crystal display device.

In (a) of FIG. 1, "100" is an entire liquid crystal display device in accordance with the present invention. The liquid crystal display device 100 includes a source driver 112 for supplying video signals to a large number of pixel electrodes 121, 122, 123, 124 . . . , a gate driver 111 for selectively driving the large number of pixel electrodes, and a common driver 114 for driving a common electrode 113 which is provided to face the large number of pixel electrodes via liquid crystal.

The above-mentioned structure may be identical with a structure of a conventional liquid crystal display device. Further, the pixel electrode itself is not limited to the one which is constituted simply by a single electrode (as illustrated in FIG. 1) but may have a structure constituted by a large number of domains. Note that, in the following explanation, a part of the liquid crystal display device 100 other than the driver circuits such as the gate driver 111, the source driver 112 and the common driver 114, that is, a part including the pixel electrodes 121, 122, 123, 124 . . . , the common electrode 113, and the liquid crystal provided and sealed between the pixel electrodes and the common electrode, is referred to as "a liquid crystal display panel", in some cases.

According to the present invention, the liquid crystal display device 100 further includes (i) a line memory 101 for receiving a video signal and storing a signal (data) corresponding to a 1-line time period, among the video signal thus received, (ii) a detector 105 for detecting a gray scale X with which an applied voltage becomes highest, which gray scale X is detected from the video signal that corresponds to the 1-line time period, and is stored in the line memory 101, (iii) a first look-up table (hereafter, referred to as "LUT 1") by use of which a common voltage (hereinafter, referred to as "COM voltage") Y is selected, which COM voltage Y is a lowest COM voltage for displaying the gray scale X and is selected on the basis of (a) a video signal for a line time period which is 1-line before the above line time period, and (b) a gray scale X of the video signal for the line time period which is 1-line before the above line time period, and (iv) a second look-up table (hereafter, referred to as "LUT 2") by use of which a most suitable γ setting for the COM voltage Y is selected. In (a) of FIG. 1, the LUT 1 is indicated by a number of "102" and the LUT 2 is indicated by a number of "106". Note that the line memory 101 is not limited to the one whose memory size is identical with a memory size for storing a signal corresponding to 1 line.

The liquid crystal display device 100 further includes (i) a COM potential generating circuit 103 which receives an output from the LUT 1 and generates a voltage (COM potential) to be applied to the common electrode, (ii) a COM signal generating circuit 104 which receives a signal from the COM potential generating circuit and generates a signal to be applied to the common electrode, (iii) a γ generating circuit 107 which receives a signal from the LUT 2 and generates an output voltage for each of gray scales, and (iv) a source output generating circuit 108 which receives an output from the γ generating circuit 107 and generates a source output to be supplied to the source driver 112.

The following description deals with, first, an outline of a method of driving a conventional liquid crystal display device, with reference to (d) of FIG. 1, and then deals with a primary concept of a method of driving a liquid crystal display device of the present invention, with reference to (b) and (c) of FIG. 1. After that, details of an operation of the liquid crystal display device 100 of the present invention will be described.

(d) of FIG. 1 shows a COM voltage 150 applied to a common electrode and source voltages 160, 161, and 162 applied to a source electrode. The COM voltage 150 and the source voltages 160, 161, and 162 are used in a general "driving method using an AC voltage as a voltage of a common signal" (hereafter, referred to as "common voltage reversal driving"). In an example shown in (d) of FIG. 1, the COM voltage 150 is reversed per 1-line time period, as shown in (d) of FIG. 1, and the source voltages 160, 161, and 162 are also reversed in accordance with the reversal of the COM voltage 150 (see (d) of FIG. 1).

Here, the liquid crystal display device is a normally-black liquid crystal display device (black is displayed while no voltage is applied across a pixel electrode and a common electrode). With the source voltage 162, a voltage 175 which is at a black level is applied across the common electrode 113 of the liquid crystal display device and the pixel electrodes 121, 122, and the like of the liquid crystal display device. With the source voltage 161, a voltage 174 which is at a gray level is applied in the same manner as the voltage 175. With the source voltage 160, a voltage 173 which is at a white level is applied in the same manner as the voltage 175. According to a conventional liquid crystal display device, an image or the like is displayed, for example, in such a manner that the source voltage thus applied is selected, in accordance with a video signal, from the voltage at the white level (source voltage 160), the voltage at the gray level (source voltage 161), and the voltage at the black level (source voltage 162), while a constant COM voltage 150 is applied. The example here deals with the normally-black liquid crystal. Note, however, that the present invention is not limited to the normally-black liquid crystal, particularly.

(b) and (c) of FIG. 1 are explanatory views showing a principle of a method of driving the liquid crystal display device of the present invention. In the case of either (b) or (c) of FIG. 1, the COM voltage 150 is reversed per 1-line time period, and the source voltages 160, 161, and 162 are also reversed in accordance with the reversal of the COM voltage 150, in the same manner as (d) of FIG. 1.

(b) of FIG. 1 shows a state of the common voltage reversal driving (driving which uses an AC voltage as a voltage of a common signal), in which the COM voltage 150 is applied and the source voltage 160 is applied. In (b) of FIG. 1, "170" represents a voltage which is applied across the common electrode 113 and the pixel electrodes 121, 122 . . . , and the like, in a case where the COM voltage 150 and the source voltage 160 are applied. Here, if a maximum source voltage 170 is applied across the common electrode 113 and the pixel electrode 121 and the like with a maximum COM voltage 150 of a specific liquid crystal display panel, the liquid crystal display device 100 carries out displaying at a white level having a maximum luminance.

On the other hand, in (c) of FIG. 1, a predetermined COM voltage 151 which is smaller than the COM voltage 150 is applied to the common electrode 113. For example, if a certain source voltage 161 is applied to a pixel electrode, a voltage 171 smaller than the maximum voltage 170 is applied across the common electrode 113 and the pixel electrode 121 and the like. In this case, the liquid crystal display device 100 carries out displaying at the gray level, for example. That is, a voltage applied to the pixel electrode is controlled in accordance with the COM voltage 151 thus reduced.

Here, if a maximum luminance in 1 line is at the gray level of the displaying carried out with the voltage 171, the COM voltage 151 shown in (c) of FIG. 1 is selected as the COM voltage. By controlling the source voltage 161 in accordance with a video signal, it is possible for the liquid crystal display device 100 to display a video corresponding to the video signal of 1 line with a gray scale selected in accordance with the video signal appropriately.

According to a conventional liquid crystal display device, as the COM voltage with which the common voltage reversal driving (driving which uses an AC voltage as a voltage of a common signal) is carried out, the maximum COM voltage 150, with which displaying can be carried out at the white level, is selected all the time (see (d) of FIG. 1). On the other hand, according to the liquid crystal display device of the present invention, the COM voltage 151 which is smaller than the maximum COM voltage 150 can be selected as the COM voltage in accordance with the maximum luminance in a 1-line time period. This makes it possible to have a significant reduction in power for generating the COM voltage.

As mentioned above, according to the present invention, a voltage applied to a pixel electrode is adjusted in accordance with the common voltage 150. It is therefore possible to apply a voltage to the pixel electrode in accordance with a target gray scale to be displayed, while carrying out driving by use of a common voltage having a low effective value. That is, it is possible to display a video with an appropriate gray scale corresponding to a video signal. Accordingly, it is possible to have a reduction in power consumption of the liquid crystal display device, while maintaining high display quality.

A rate of a reduction in power changes depending on a size of a liquid crystal panel, a resolution, and an image to be displayed. For example, in a case where a common voltage becomes 0 V in a 3.2 HVGA liquid crystal module (according to the present invention, in a case where an image in which a gray scale higher than a certain gray scale is not used is displayed (such as a case where black is displayed on an entire screen)), there is a reduction by approximately 40% in power consumption of a liquid crystal panel.

On the other hand, in case where white is displayed on the entire screen, an effect of reducing power becomes 0%. However, in displaying an actual image, there is almost never such an image that white is displayed on the entire screen. That is, generally, an image thus displayed is in a range between black display and white display. Therefore, the effect of reducing power becomes generally in a range of 0% to 40%. As mentioned above, the effect of reducing power changes depending on an image to be displayed. For general images, an average of the effect of reducing power is expected to be in a range of approximately 10% to approximately 15%. The bigger a size of the liquid crystal panel becomes and the higher the resolution becomes, the higher a percentage of power consumption of the common voltage to power consumption of the entire liquid crystal panel becomes. That is, usefulness of the present invention also becomes higher.

Details of an example of the present invention is described below more specifically with reference to (a) of FIG. 1, (a), (b), and (c) of FIG. 2, (a) and (b) of FIG. 3, (a), (b), and (c) of FIG. 4, (a) and (b) of FIG. 5, (a), (b) and (c) of FIG. 6, and (a) and (b) of FIG. 7.

Figure 2:
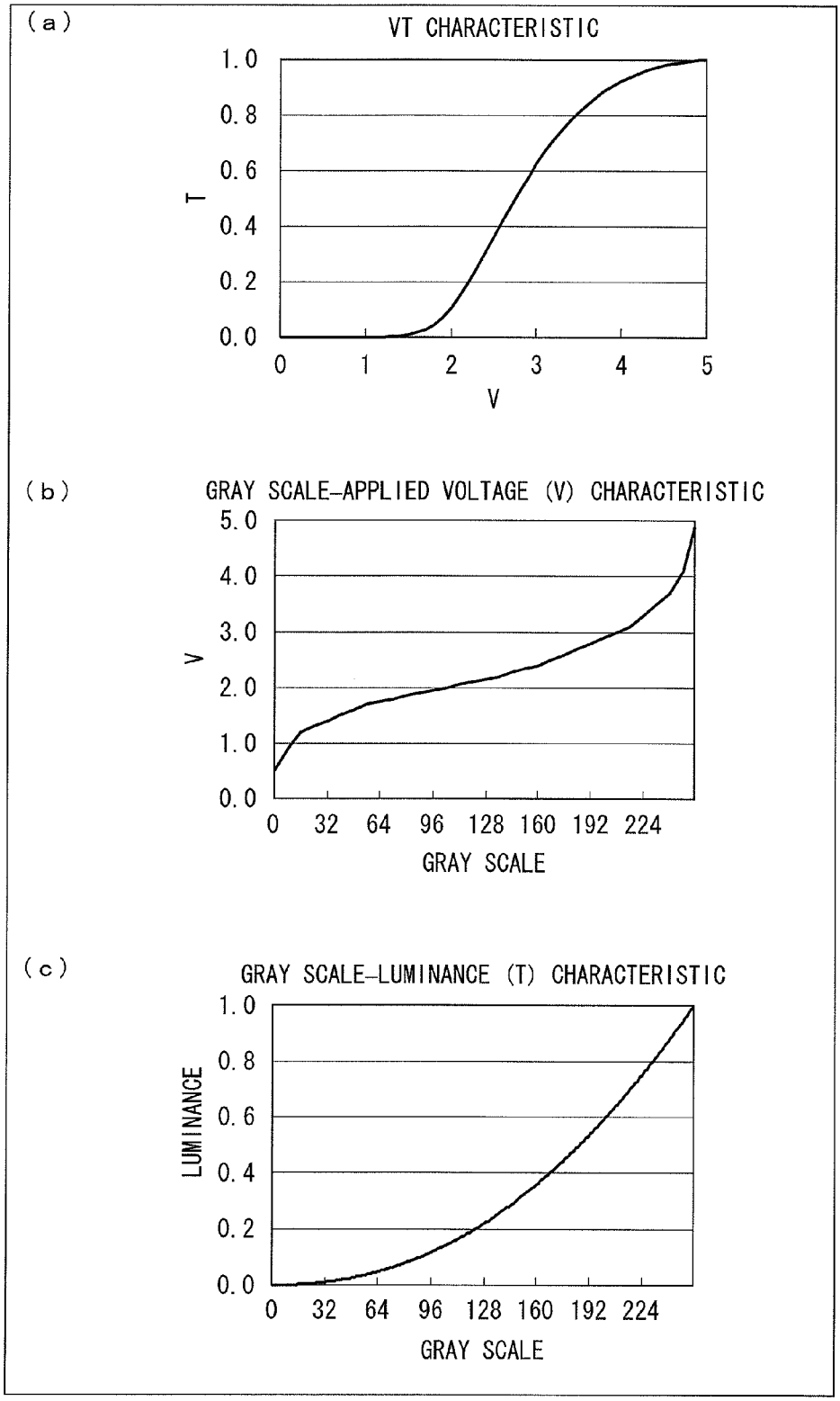
FIG. 2 is a view showing characteristics of a liquid crystal display panel.

The following description deals with a case where a gray scale-applied voltage characteristic shown in (b) of FIG. 2 is added to a display (liquid crystal display panel) having a VT characteristic shown in (a) of FIG. 2, and therefore a gray scale-luminance characteristic shown in (c) of FIG. 2 is obtained. The display includes the LUT 1 shown in (a) of FIG. 3 and the LUT 2 shown in (b) of FIG. 3.

The LUT 1 is a table in which each of detected maximum gray scales 0 to 255, surrounded by a frame 301 having an elliptical shape in (a) of FIG. 3, is associated with a corresponding COM voltage. For example, a detected maximum gray scale n is associated with 3.6 V. This means that a lowest COM voltage within a range in which the gray scale n can be displayed is 3.6 V.

The LUT 2 is a table with which, for each of values of the detected maximum gray scales surrounded by a frame 302 having an elliptical shape in (b) of FIG. 3, an output gray scale can be set with respect to an input gray scale. That is, with the LUT 2, it is possible to have an optimum γ setting with respect to a certain COM voltage. For example, according to the present example, in a case where the detected maximum gray scale is n, the COM voltage is 3.6 V. In this case, an output gray scale 0 is set with respect to an input gray scale 0, an output gray scale 4 is set with respect to an input gray scale 1, an output gray scale 8 is set with respect to an input gray scale 2, an output gray scale 10 is set with respect to an input gray scale 3 . . . , and an output gray scale 255 is set with respect to an input gray scale n. How to create the LUT 1 and LUT 2 will be described later.

First, the following description deals with a case where a video signal corresponding to a certain line (a 1-line time period) is gray scale data shown in (a) of FIG. 4. According to the gray scale data shown in (a) of FIG. 4, a gray scale with which an applied voltage becomes highest is a gray scale 255. The gray scale 255 corresponds to a highest luminance among gray scales at which displaying can be carried out by a liquid crystal display device.

In a case where the gray scale data (video signal) shown in (a) of FIG. 4 is inputted into the line memory 101 (see (a) of FIG. 1), the line memory 101 stores the gray scale data corresponding to a 1-line time period and transmits the gray scale data to the detector 105. The detector 105 detects, among the gray scale data corresponding to the 1-line time period (hereinafter, merely referred to as "1 line" in some cases), the gray scale 255 with which an applied voltage becomes highest. In (a) of FIG. 4, a frame 401 having an elliptical shape shows that the gray scale 255 at a position having a column number of n is selected as a gray scale with which an applied voltage becomes highest. The gray scale 255 detected by the detector 105 is transmitted to the LUT 1 and the LUT 2, together with the gray scale data (video signal) which corresponds to 1 line and from which the gray scale 255 has been detected.

In the above explanation, a maximum gray scale is detected from a video signal corresponding to a 1-line time period, as an example. Note, however, that, as explained later, the "detection time period for detecting a maximum gray scale" is not limited to the 1-line time period. Note that, hereafter, the "detection time period for detecting a maximum gray scale" is merely referred to as "detection time period", in some cases.

In a case where the gray scale 255 with which an applied voltage becomes highest in 1 line is transmitted to the LUT 1, a voltage (COM voltage) of 5 V which is associated with the gray scale 255 in the LUT 1 is selected as a voltage applied to the common electrode. That is, a part of the detected maximum gray scales surrounded by the frame 301 having an elliptical shape in (a) of FIG. 3 is referred to, and the COM voltage of 5.0 V, which is associated with the gray scale 255 in (a) of FIG. 3, is selected. A frame 402 having an elliptical shape in (b) of FIG. 4 shows that a voltage of 5.0 V is selected as the COM voltage.

Meanwhile, in a case where the gray scale 255 with which an applied voltage becomes highest in 1 line is transmitted to the LUT 2, a part of the detected maximum gray scales in the LUT 2 (the frame 302 having an elliptical shape in (b) of FIG. 3) is referred to, and a column of the detected maximum gray scale 255 is selected. A frame 403 having an elliptical shape in (c) of FIG. 4 shows the selection of the column. In the part thus selected, surrounded by the frame 403 having an elliptical shape in the LUT 2, a relationship between an input gray scale and an output gray scale is set so that an optimum γ setting is achieved with the COM voltage of 5 V. In this case, since the detected maximum gray scale is 255, the input gray scales and the output gray scales are identical with each other.

In a case where a COM potential of 5 V is selected based on the LUT 1, the COM voltage of 5 V is generated by the COM potential generating circuit 103. Further, the COM signal generating circuit 104 generates a COM signal which is to be outputted to the liquid crystal display panel (LCD). That is, the COM signal is supplied to the common driver 114 of the liquid crystal display panel and the common electrode of the liquid crystal display panel is driven by the COM signal.

Meanwhile, the output gray scale data (data of a part surrounded by the frame 403 having an elliptical shape in (c) of FIG. 4) set by the LUT 2 is supplied to the γ generating circuit 107 and is converted by the γ generating circuit 107 into an output voltage for each of the gray scales. Further, the source output generating circuit 108 generates a data signal to be outputted to the liquid crystal display panel (LCD). That is, the data signal generated by the source output generating circuit 108 is supplied to the source driver 112 and the liquid crystal display panel carries out displaying by using the data signal.

Figure 5:
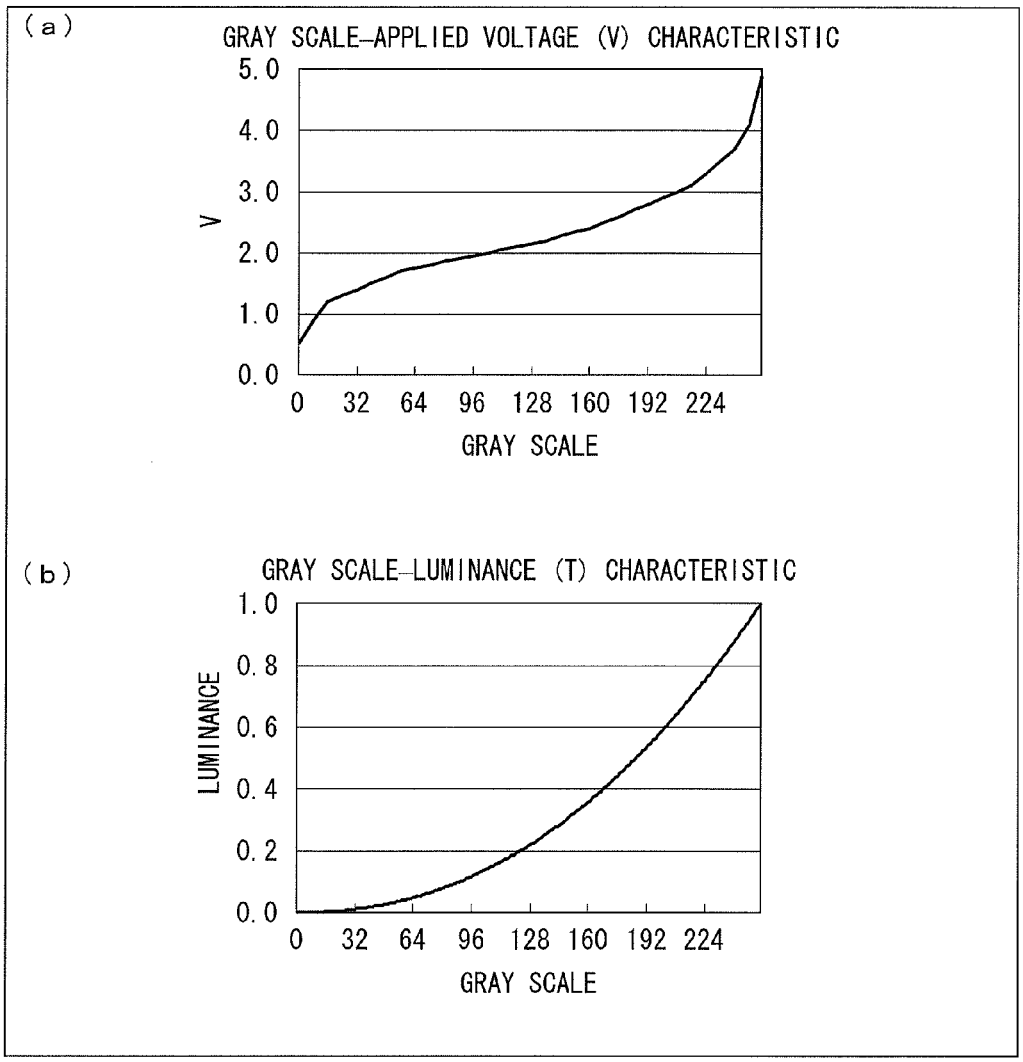
FIG. 5 is a view showing a gray scale-applied voltage characteristic and a gray scale-luminance characteristic, each of which is obtained based on the specific gray scale data (video signal).

By appropriately determining values of the LUT 1 and values of the LIT 2, it is possible to obtain a liquid crystal display device which has (i) the gray scale-applied voltage characteristic shown in (a) of FIG. 5 and (ii) the gray scale-luminance characteristic shown in (b) of FIG. 5. Note that how to create the LUT 1 and LIT 2 will be mentioned later.

Next, the following description deals with a driving method in a case where the maximum gray scale in a 1-line time period is not 255. Here, the maximum gray scale in the 1-line time period is "n". In the following explanation, an operation is divided into a plurality of steps so that the explanation can be easily understood.

[Step 1] In a case where a video signal corresponding to a certain line is gray scale data shown in (a) of FIG. 6, the gray scale data is stored in the line memory 101 and is transmitted to the detector 105.

[Step 2] The detector 105 detects, among the gray scale data which corresponds to the 1-line time period and is stored in the line memory 101, a gray scale n with which an applied voltage becomes highest. This state is indicated by a frame 601 having an elliptical shape in (a) of FIG. 6.

[Step 3] A result of the detection carried out by the detector 105, i.e., "n", is transmitted to the LUT 1 and the LUT 2.

[Step 4] On the basis of the LUT 1, a COM voltage of 3.6 V, which is a lowest COM voltage within such a range that the gray scale n can be displayed, is selected. This state is indicated by a frame 602 having an elliptical shape in (b) of FIG. 6.

[Step 5] On the basis of the LUT 2, a relationship between the input gray scale and the output gray scale is selected in response to the gray scale n so that an optimum γ setting for the COM voltage of 3.6 V is obtained. This state is indicated by a frame 603 having an elliptical shape in (c) of FIG. 6. As is clear from the LUT 2, the detected maximum gray scale is n. Accordingly, in a case where an input gray scale is n, an output gray scale is 255.

[Step 6] In response to a signal of 3.6 V selected by use of the LUT 1, the COM potential generating circuit 103 generates the COM voltage of 3.6 V.

[Step 7] The γ generating circuit 107 (i) receives the output gray scale selected by use of the LUT 2, (ii) generates an output voltage for each of the gray scales, and (iii) transmits the output voltage to the source output generating circuit 108.

[Step 8] The COM signal generating circuit 104 generates a COM signal which is to be outputted to the common driver 114.

[Step 9] The source output generating circuit 108 receives data from the γ generating circuit 107 and generates a data signal which is to be outputted to the source driver 112. The above Steps 6 through 9 can be carried out by use of a technique which is identical with a conventional technique.

Figure 7:
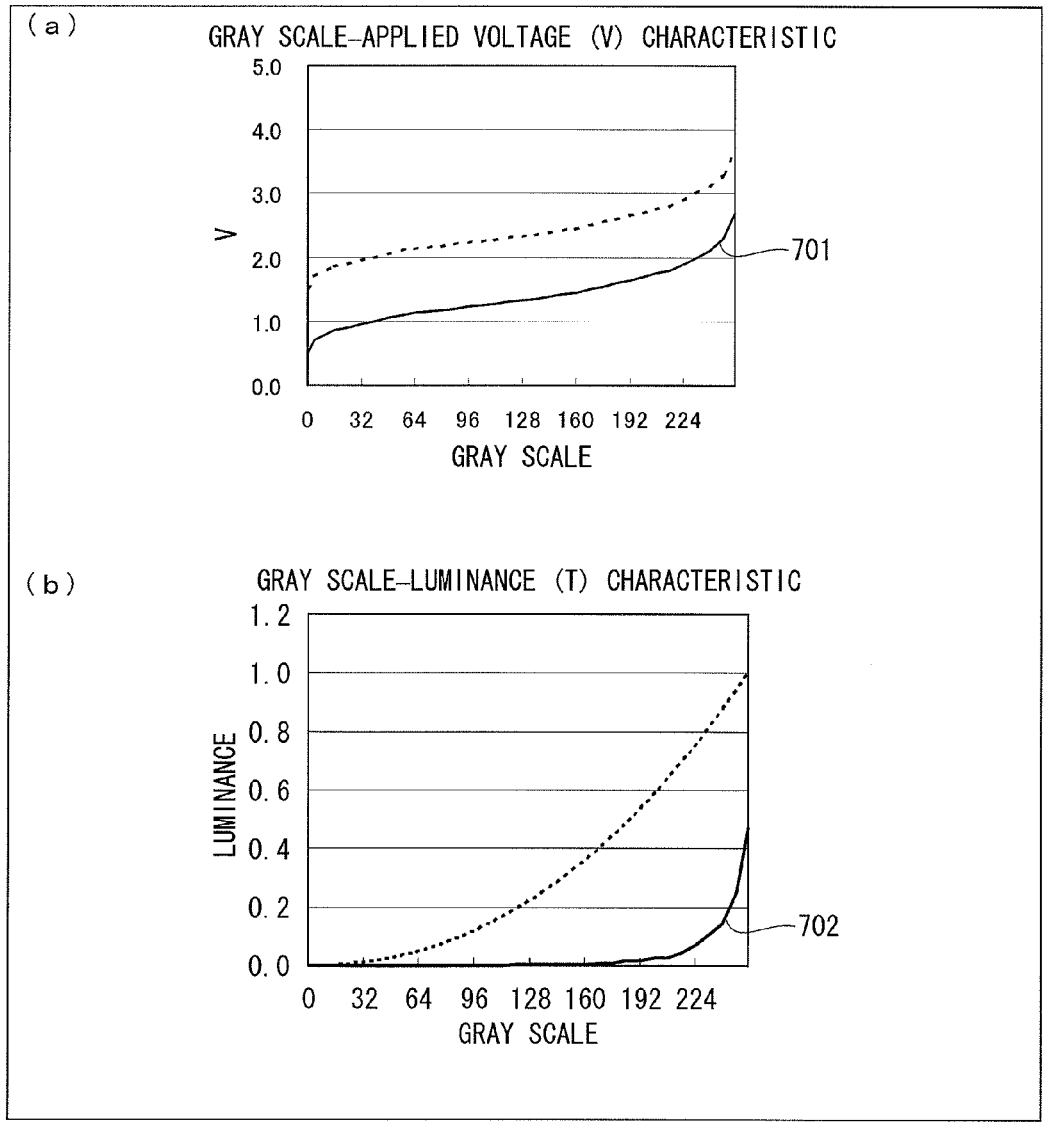
FIG. 7 is a view showing a gray scale-applied voltage characteristic and a gray scale-luminance characteristic, each of which is obtained based on other gray scale data (video signal).

Based on (i) the COM voltage of 3.6 V selected by referring to the LUT 1 in Step 4, and (ii) the relationship between the input gray scale and the output gray scale, selected by referring to the LUT 2 in Step 5, a gray scale-applied voltage (V) characteristic indicated by a line segment 701 in (a) of FIG. 7 and a gray scale-luminance (T) characteristic indicated by a line segment 702 in (b) of FIG. 7 can be obtained.

Here, for each of gray scales whose values are not more than that of the gray scale n, the output gray scale is converted so that an applied voltage becomes identical with an applied voltage with the maximum detected gray scale 255. Accordingly, in a case where the COM voltage is reduced from 5.0 V to 3.6 V, it is possible to maintain the applied voltage which is identical with the applied voltage before the conversion of the gray scale by use of the LUT 2.

It is therefore possible to achieve an effect of reducing power consumption by reducing the COM voltage, while preventing a reduction in applied voltage due to a reduction in COM voltage of an image. The smaller the maximum detected gray scale of each line is, the lower the COM voltage can become. That is, it is possible to carry out driving with a common voltage having a low effective value. It is thus possible to achieve an effect of significantly reducing power consumption. In addition, as mentioned above, in obtaining such an effect, there is no negative influence on display quality.

The effect of reducing power varies depending on an image to be displayed. Generally, however, as a liquid crystal panel, an expected low power consumption effect is approximately 40% at a maximum. With an image such as a general landscape, an expected low power consumption effect is in a range of approximately 10% to approximately 15%.

Note that the common voltage reversal driving (driving which uses an AC voltage as a voltage of a common signal) can be applied to a driving method which uses an AC voltage as a voltage of a common signal. For example, the common voltage reversal driving can be applied to horizontal line reversal driving, frame reversal driving, vertical line reversal driving, and the like.

Further, in the above description, the "detection time period for detecting a maximum gray scale" is a 1-line time period. Note, however, that the present invention is not limited to this. The "detection time period for detecting a maximum gray scale" may be such a time period that a video signal corresponding to a certain time period is obtained, and a maximum gray scale in the certain time period is detected. For example, the "detection time period for detecting a maximum gray scale" may be either a 1-frame time period or a time period corresponding to a plurality of lines. That is, in the case of the frame reversal driving, for example, it is possible that the "detection time period for detecting a maximum gray scale" may be either (i) a time period corresponding to 1 line, or (ii) a time period corresponding to 1 frame. For such a case, it is necessary to cause, as a matter of course, the line memory 101 described above to have at least a capacity for storing a signal (data) of the "detection time period for detecting a maximum gray scale".

In a case where the "detection time period for detecting a maximum gray scale" is set to be a time period corresponding to 1 line, it becomes possible to carry out driving with a delicate setting, i.e., with a COM voltage set per 1-line time period. Accordingly, it is possible to carry out efficient driving with low power consumption.

In a case where the "detection time period for detecting a maximum gray scale" is a time period corresponding to 1 frame, a common voltage is controlled per frame. In this case, it is possible to have a reduction in power consumption of a liquid crystal display device, while causing an amount of a control process to be relatively small. Accordingly, it is possible to obtain a liquid crystal display device which is low in cost.

Next, the following description deals with how to set the LUT 1 with reference to (a) through (d) of FIG. 8.

As explained above with reference to (a) through (c) of FIG. 1, a COM signal is generated by the COM signal generating circuit 104 as a rectangular wave whose amplitude is a COM amplitude voltage. Further, a source output signal is generated by the source output generating circuit 108 as a data signal whose amplitude is set in accordance with a gray scale.

(a) of FIG. 8 is a view showing a relationship between an amplitude (COM amplitude voltage 811) of a COM signal, an amplitude (source amplitude voltage 813) of a source output signal, and a voltage 812 applied to the common electrode 113. As is clear from (a) of FIG. 8, the following formula is satisfied.

$$V=(Vs+Vcom)/2$$

(where: Vs is the source amplitude voltage; Vcom is the COM amplitude voltage; and V is the applied voltage.).

A relationship between a gray scale generated by the source output generating circuit 108 and the source amplitude voltage is identical with the relationship shown in (b) of FIG. 8, for example. In this case, a voltage applied with a certain gray scale n is searched on the basis of a VT characteristic of a liquid crystal display panel in use, and a COM voltage, with which a desired applied voltage can be obtained with the source amplitude voltage corresponding to the gray scale 255, is calculated from the above formula.

For example, a gray scale is n shown in a right graph of (c) of FIG. 8. A luminance at the gray scale n is 0.94, for example. In this case, on the basis of the VT characteristic shown in a left graph of (c) of FIG. 8, an applied voltage V of 4.3 V can be obtained. The source amplitude voltage Vs corresponding to the 255 gray scale is 5.0 V. By applying the source amplitude voltage Vs to the aforementioned formula, the following formula is satisfied.

$$4.3=(5.0+Vcom)/2$$

From this formula, Vcom=3.6 V can be obtained. (d) of FIG. 8 shows the LUT 1 in which the Vcom for each of the gray scales is shown.

Next, the following description deals with how to set the LUT 2 with reference to (a) through (d) of FIG. 9.

First, based on the VT characteristic unique to a liquid crystal display panel, a voltage applied under such a condition that a maximum COM voltage is set is found for each of the gray scales. This can be carried out by referring to the VT characteristic shown in (a) of FIG. 2, for example. This state is indicated by a frame 901 having an elliptical shape in (a) of FIG. 9.

As described above with reference to (a) of FIG. 8, the following formula is satisfied, $$V=(Vs+Vcom)/2$$

(where: Vs is the source amplitude voltage; Vcom is the COM amplitude voltage; and V is the applied voltage).

By use of a maximum COM amplitude voltage (e.g., 5.0 V), the source amplitude voltage Vs is found for each of the applied voltages surrounded by the frame 901 having an elliptical shape shown in (a) of FIG. 9.

For example, in a case where, at the gray scale 255, the applied voltage is V=4.9, and the COM amplitude voltage is Vcom=5.0, the source amplitude voltage of Vs=4.8 is calculated by use of the above formula. (b) of FIG. 9 shows, in an arranged manner, source amplitude voltages calculated with respect to all the gray scales, respectively.

Next, an applied voltage (V) for a case where the COM amplitude voltage (Vcom) is changed is obtained by use of the following formula by use of a "source amplitude voltage (Vs) necessary for displaying each gray scale", obtained in (b) of FIG. 9.

$$V=(Vs+V\text{com})/2$$

For example, on the basis of the part surrounded by a frame 904 having an elliptical shape shown in (b) of FIG. 9, a voltage of 4.8 V is obtained as a source amplitude voltage (Vs) for displaying the gray scale 255. An applied voltage V is calculated by applying, to the above formula, the source amplitude voltage (Vs) of 4.8 V and the COM amplitude voltage (Vcom) of 4.0 V.

$$V=(4.8+4.0)/2$$

An applied voltage of 4.4 V is thus obtained.

In the same manner as described above, for the gray scale 248, an applied voltage of 3.6 V is obtained by use of a source amplitude voltage (Vs) of 3.2 V and a COM amplitude voltage (Vcom) of 4.0 V. This state is indicated by a frame 903 having an elliptical shape in (a) of FIG. 9. The calculation is carried out with respect to all the gray scales, and then the calculation is repeated in such a manner that the COM amplitude voltage (Vcom) is changed. As a result, values surrounded by a frame 902 shown in (a) of FIG. 9 are obtained. (a) of FIG. 9 shows results obtained by use of the COM amplitude voltages 0 V, 1 V, 2 V, 3 V, 4 V, and 5 V.

Note that such a gray scale, with which a result of the calculation is not within a range of an output voltage before conversion is not used. Here, the "range of an output voltage before conversion" means a range of "an applied voltage with which black is displayed under such a condition that the detected gray scale is maximum" to "an applied voltage with which white is displayed under such a condition that the detected gray scale is maximum". Generally, liquid crystal has such a characteristic that a molecule doesn't move with a voltage not more than a threshold voltage. According to the present embodiment, the threshold value for the liquid crystal is set to be 0.5 V. As such, with an applied voltage in a range of 0 V to 0.5 V, the liquid crystal has the same transmittance. For this reason, in order to avoid unnecessary setting of gray scale expression, a minimum gray scale is set to be not less than 0.5 V.

Further, a region in which an applied voltage is negative is not used as well. That is, a value in such a region is not in a range of a desired applied voltage in a case where the detected gray scale is maximum. Accordingly, it is unnecessary to apply such a voltage even in a case where the common voltage is changed.

(c) of FIG. 9 is a graph showing a relationship between the gray scale and the applied voltage, which relationship is shown in (a) of FIG. 9. In (c) of FIG. 9, six examples employing COM amplitude voltages 0 V, 1 V, 2 V, 3 V, 4 V, and 5 V, respectively, are shown. By referring to (c) of FIG. 9, gray scales with which the same applied voltage is obtained are calculated for each of input gray scales, so as to create the LUT 2. For example, as shown in a dashed line in (c) of FIG. 9, an applied voltage V1 is obtained with respect to an input gray scale i with the COM amplitude voltage of 5.0 V. Meanwhile, at an intersection between a line segment of the applied voltage V1 and a line segment of the COM amplitude voltage of 3.0 V, an output gray scale I with the COM amplitude voltage of 3.0 V is obtained.

In the same manner as described above, with respect to each of the input gray scales, an output gray scale with the COM amplitude voltage of 3.0 V is obtained. Note that in a case of an input gray scale imax, an output gray scale with the COM amplitude voltage of 3.0 V becomes a maximum gray scale 255. Therefore, in other words, in a case where a gray scale with which an input gray scale becomes maximum is the gray scale imax, it is possible to carry out driving with the COM amplitude voltage which is reduced down to 3.0 V. (d) of FIG. 9 is a table obtained by calculating such values for all the COM amplitude voltages 0, 1, 2 . . . . In the table shown in (d) of FIG. 9, the input gray scales, and the output gray scales are associated with each other.

By using the LUT 1 and the LUT 2 set by the aforementioned method, it is possible to realize (i) a driving method which uses a low COM voltage without changing the applied voltage (a voltage applied across a pixel electrode and a common electrode) corresponding to each of the input signals, and (ii) a reduction in power consumption of a liquid crystal display device.

According to the examples described above, such common voltage reversal driving that a voltage applied to a common electrode is reversed per 1-line time period is carried out. Note, however, that the present invention is not limited to this. As mentioned above, the method of the present invention can be applied to a method in which a common voltage is driven by an AC signal. For example, the method of the present invention can be applied to the horizontal line reversal driving, the frame reversal driving, the vertical line reversal driving, and the like. Note that the line reversal driving encompasses the horizontal line reversal driving and the vertical line reversal driving.

In a case of a liquid crystal display device which carries out such general common voltage reversal driving, the line memory 101 shown in (a) of FIG. 1 is a memory for storing a video signal corresponding to a certain time period (which is the "detection time period for detecting a maximum gray scale"), and the detector 105 is a detector for detecting, among the video signal which corresponds to the certain time period and is stored in the memory, a gray scale X with which an applied voltage becomes highest. Further, a liquid crystal display device of the present invention includes (i) a first look-up table with which a lowest common voltage Y in such a range that the gray scale X can be displayed is selected with the use of (a) a video signal corresponding to a previous certain time period, and (b) a gray scale X in the video signal corresponding to the previous certain time period, and (ii) a second look-up table with which an optimum γ setting for the common voltage Y is selected.

As explained above, the "detection time period for detecting a maximum gray scale" is not limited to a time period corresponding to 1 line but may be a 1-frame time period or a time period corresponding to a plurality of lines. That is, in the case of the frame reversal driving, for example, it is possible to use, as the "detection time period for detecting a maximum gray scale", either a time period corresponding to 1 line or a time period corresponding to 1 frame. Further, in this case, it is also possible to use a time period corresponding to a plurality of lines.

Note that the present invention is not limited to the above-mentioned embodiments. A person skilled in the art can alter, in various ways, the present invention within the scope of claims. That is, within the scope of claims, a new embodiment can be obtained by combining technical means altered appropriately.

[Conclusion of the Present Invention]

In another method of driving a liquid crystal display device in accordance with the present invention, a voltage applied to a pixel electrode is controlled in accordance with the common voltage thus reduced.

With the arrangement, since a voltage applied to a pixel electrode is adjusted in accordance with a common voltage, it is possible to apply a voltage to the pixel electrode in accordance with a target gray scale, while carrying out driving with the use of a common voltage whose effective value is low. Therefore, it is possible to have a reduction in power consumption of a liquid crystal display device, while maintaining high display quality.

In still another method of driving a liquid crystal display device in accordance with the present invention, the detection time period for detecting a maximum gray scale is a time period corresponding to 1 line.

With the arrangement, it becomes possible to carry out driving with a delicate setting, i.e., with a common voltage set per 1-line time period. Accordingly, it is possible to carry out efficient driving with low power consumption.

In still another method of driving a liquid crystal display device in accordance with the present invention, the detection time period for detecting a maximum gray scale is a time period corresponding to 1 frame.

With the arrangement, a common voltage is controlled per frame. Accordingly, it is possible to have a reduction in power consumption of a liquid crystal display device while causing an amount of a control process to be relatively small.

In still another method of driving a liquid crystal display device in accordance with the present invention, the common voltage reversal driving is line reversal driving or frame reversal driving.

With the arrangement, it is possible that, with a liquid crystal display device employing line reversal driving or frame reversal driving, power consumption of the liquid crystal display device is reduced while high display quality is maintained.

In another liquid crystal display device in accordance with the present invention, the detection time period for detecting a maximum gray scale is a time period corresponding to 1 line.

With the arrangement, it becomes possible to carry out driving with a delicate setting, i.e., with a common voltage set per 1-line time period. Accordingly, it is possible to provide a liquid crystal display device which can carry out efficient driving with low power consumption.

In another liquid crystal display device in accordance with the present invention, the detection time period for detecting a maximum gray scale is a time period corresponding to 1 frame.

With the arrangement, a common voltage is controlled per frame. Accordingly, it is possible to provide a liquid crystal display device which can have a reduction in power consumption of a liquid crystal display device while causing an amount of a control process to be relatively small.

In another liquid crystal display device in accordance with the present invention, the common voltage reversal driving is line reversal driving or frame reversal driving.

With the arrangement, it is possible to obtain a liquid crystal display device employing line reversal driving or frame reversal driving, which liquid crystal display device realizes driving with low power consumption, while maintaining high display quality.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention is to provide a liquid crystal display device and a method of driving a liquid crystal display device, each of which can have a reduction in power consumption while maintaining high display quality of a liquid crystal display panel. The present invention has high industrial applicability, and is applicable to a television, a portable device, and the like, in each of which a liquid crystal display device is incorporated.

REFERENCE SIGNS LIST

100: Liquid crystal display device
101: Line memory
102: First look-up table (LUT 1)
103: COM potential generating circuit
104: COM signal generating circuit
105: Detector for detecting a gray scale with which an applied voltage becomes highest.
106: Second look-up table (LUT 2)
107: γ generating circuit
108: Source output generating circuit
111: Gate driver
112: Source driver
113: Common electrode
114: Common driver

The invention claimed is:

1. A liquid crystal display device for carrying out such common voltage reversal driving that a common voltage is reversed per predetermined time period, comprising:

a gate driver;

a source driver;

a common driver;

a memory for (i) setting a certain time period in a video signal as a detection time period for detecting a maximum gray scale, and (ii) storing a signal corresponding to the certain time period;

a detector for detecting, among the signal which corresponds to the certain time period and is stored in the memory, a gray scale X with which an applied voltage becomes highest;

a first look-up table with which a lowest common voltage Y in a range for displaying the gray scale X is selected with the use of (i) a signal corresponding to a previous detection time period and (ii) a gray scale X in the signal corresponding to the previous detection time period; and a second look-up table with which an optimum γ setting for the common voltage Y is selected.

2. The liquid crystal display device as set forth in claim 1, wherein:

the detection time period for detecting a maximum gray scale is a time period corresponding to 1 line.

3. The liquid crystal display device as set forth in claim 2, wherein:

the detection time period for detecting a maximum gray scale is a time period corresponding to 1 frame.

4. The liquid crystal display device as set forth in claim 2, wherein:

the common voltage reversal driving is line reversal driving or frame reversal driving.

* * * * *